US007805874B2

(12) United States Patent
Tal et al.

(10) Patent No.: US 7,805,874 B2
(45) Date of Patent: Oct. 5, 2010

(54) MULTI-ROUND MAGAZINE LOADER AND UNLOADER

(76) Inventors: Guy Tal, P.O. Box 302, Rosh Ha'ayin (IL) 48103; Ran Tal, P.O. Box 302, Rosh Ha'ayin (IL) 48103

( * ) Notice: Subject to any disclaimer, the term of this patent is extended or adjusted under 35 U.S.C. 154(b) by 142 days.

(21) Appl. No.: 12/156,624

(22) Filed: Jun. 4, 2008

(65) Prior Publication Data

US 2009/0044440 A1 Feb. 19, 2009

(30) Foreign Application Priority Data

Jun. 27, 2007 (IL) ..... 184255

(51) Int. Cl.
*F41A 9/61* (2006.01)

(52) U.S. Cl. ..... 42/87

(58) Field of Classification Search ..... 42/87, 42/106

See application file for complete search history.

(56) References Cited

U.S. PATENT DOCUMENTS

| | | | |
|---|---|---|---|
| 1,355,684 | A | 10/1920 | Northover |
| 2,014,177 | A | 9/1935 | Herlach et al. |
| 2,403,012 | A | 7/1946 | McPheters |
| 2,462,836 | A | 3/1949 | Barker et al. |
| 2,783,570 | A | 3/1957 | Kunz |
| 2,834,137 | A | 5/1958 | Kunz |
| 2,856,720 | A | 10/1958 | Kunz |
| 3,032,907 | A | 5/1962 | Parker |
| 3,710,497 | A | 1/1973 | Musgrave |
| 3,854,232 | A | 12/1974 | Musgrave |
| 3,916,552 | A | 11/1975 | Pichard |
| 3,939,590 | A | 2/1976 | Musgrave |
| 4,538,371 | A | 9/1985 | Howard |
| 4,574,511 | A | 3/1986 | Csongor |
| 4,614,052 | A | 9/1986 | Brown et al. |
| 4,706,402 | A | 11/1987 | Csongor |
| 5,417,003 | A | 5/1995 | Claveau |
| 5,669,171 | A | 9/1997 | Sally |
| 6,754,987 | B1 | 6/2004 | Cheng et al. |
| 6,810,616 | B2 | 11/2004 | Tal |
| 7,059,077 | B2 | 6/2006 | Tal |

FOREIGN PATENT DOCUMENTS

| | | |
|---|---|---|
| EP | 205661 | 12/1986 |
| GB | 379179 | 8/1932 |

OTHER PUBLICATIONS

US Government Stock U.S. Appl. No. 11,010,483 10-round metal stripper clip.

US Government Stock U.S. Appl. No. 11,010,484 Metal guide / adapter.

*Primary Examiner*—Michelle Clement
(74) *Attorney, Agent, or Firm*—David Pressman

(57) ABSTRACT

A firearm magazine loader for loading both rounds held by a stripper clip and for loading loose rounds into a magazine comprises, in one aspect, a stick-like body having a lower portion adapted to fit over and attach to an open top end of a magazine and an upper portion for receiving a loaded stripper clip or loose rounds. A tiltable and slideable slider is coupled inseparably to slots in the upper portion and slidable along it. Loading is achieved by using the slider to thrust down the top-most round in the upper portion, causing all other rounds below to be forced sequentially and quickly into the magazine. The loader also includes and unloading flange for unloading rounds from the magazine.

20 Claims, 3 Drawing Sheets

MULTI-ROUND MAGAZINE LOADER AND UNLOADER

CROSS-REFERENCE TO RELATED APPLICATION

This application claims the benefit of Israeli patent application No. 184255, filed Jun. 27, 2007.

BACKGROUND

1. Field

The creation relates to firearm magazine loaders, particularly to a loader and method for loading both rounds held by stripper clips or loose rounds. This creation is associated with our U.S. Pat. Nos. 7,059,077, Jun. 13, 2006, and 6,810,616, Nov. 2, 2004, and our international patent application Ser. Nr. WO2006/109315, filed Oct. 19, 2006.

2. Prior Art

Firearms, including pistols, assault rifles, and submachine guns, utilize and fire rounds (also known as cartridges and ammunition). Each round is substantially elongated and comprises a deep cuplike case (also known as a shell case and sometimes also a cartridge), usually of brass, which is filled with an explosive propellant. At its rear or closed end, the case has a rim or flange containing a primer; next to it is an extractor groove, an annular groove machined into the case which provides a grip for the gun's extractor to pull the fired or unfired case from the chamber of the firearm. The front and opposite end of the case is open. A bullet, projectile, or head, usually of lead (optionally jacketed) is partially inserted into the open or front end of the case by crimping the case onto the bullet. The open or front end of the case may be crimped down or closed in 'blank' rounds.

The rounds are held within and fed into the firearm from a magazine. Detachable magazines have become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which is attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular opening and includes two round-retaining members, known as feed lips, that project into or partly close the opening. An internal spring urges a follower or pusher (a shaped piece of plastic or metal) toward the open side. The follower in turn urges the rounds as a group up against the lips. The lips act as a stop for the rounds so that they are not expelled from the magazine.

Rounds are stacked or oriented in the magazine such that the longitudinal axes of the rounds are substantially parallel and perpendicular to the direction of travel of the spring and follower. Adjoining rounds are oriented side-by-side and in the same direction, i.e., the bullets of adjacent rounds are next to each other, as are the cases.

The rounds are usually stacked in the magazine, either in a single straight column or in a staggered (zigzag) column (also called double-stacked or high-capacity) fashion. The latter magazines, being wider, have a higher round capacity compared to single-column magazines of the same overall length.

Commonly, magazines of assault rifles, such as the AR-15/M-16, and submachine guns, contain staggered rounds. At the top of such magazines, the lips alternately retain the left and right top-most round, as the rounds are fed up and picked off. The top-most round is held in place by only one of the lips, in contrast to most pistol magazines. Hereafter the term 'magazine' will mean magazines where the lips alternately retain the top-most round.

Rounds are available in the market packed either loose in a box, or bound in strips on plastic or metal stripper clips (also called retainer strips or cartridge clips). Common AR-15/M-16 stripper clips are approximately 100 mm in length, 12 mm wide, and 4 mm deep and are arranged to slidably hold the rounds in a column by flanges or ribs which engage or enter the circumferential extractor groove of the rounds. Since most military magazines hold 30 rounds, three 10-round stripper clips are required to fill one magazine. For many years the US military issued soldiers small caliber (5.56/.223) ammunition for their M-16 and M-4 assault rifles bounded in 10-round metal stripper clips (US Government Stock No. 11,010,483).

Prior to use, a firearm magazine must be loaded, charged, or filled with rounds. When a magazine is being loaded, it is necessary to depress all previously loaded rounds to provide vacant space below the lips so an additional round can be inserted or loaded into this space. Each time another round is loaded the spring is further compressed, requiring more insertion force.

When a magazine is fully loaded, the spring is fully compressed and exerts maximum upward force against the follower and rounds towards the lips.

Loading magazines with loose rounds is a relatively time-consuming, tedious, and painful practice if done with bare fingers. Pain accumulates and intensifies as more rounds are loaded against the increasing spring pressure, thus slowing the loading process. When a plurality of magazines are to be loaded, much time is required, shortening reposing, training, or combat time. In combat circumstances, slow reloading can be life-threatening.

Loading rounds from stripper clips into magazines has the advantage of speed compared to loading loose rounds, provided that all the rounds are pre-loaded onto the stripper clips first. However, it is usually more difficult to load rounds from a stripper clip than it is to load loose rounds into a magazine, one by one, since more force is required to overcome the friction of the rounds with the stripper clip, in addition to the force of the magazine's spring. Many users have cut their fingers loading rounds and have additional difficulties in cold weather. Thus, some users prefer to manually strip the rounds from the stripper clips, one by one, and load them with a loader and unloader (e.g., as described in our U.S. Pat. No. 6,810,616 and sold under the trademark LULA by Maglula, Ltd. of Israel) or with bare fingers into the magazine.

Unloading rounds from magazines is required for magazine cleaning, repair, training, overall safety, and for storage. While this can be done with bare fingers, it usually causes pain due to the difficulty of overcoming the force of the magazine's spring.

The prior art shows numerous attempts to provide adequate magazine loaders for loading bound rounds on stripper clips and loaders for loading loose rounds. The prior art also describes magazine unloaders. Some of these loaders and unloaders are shown in the following references:

EP patent 205,661 to Samet et. al., Dec. 30, 1986 describes a loader for loading both bound rounds on stripper clips and loose rounds into a magazine. This loader is very large, bulky, and comprises many parts.

GB patent 379,179 to Knoller, Aug. 25, 1932, discloses a loader for multiple stripper clips. The loader has an elongated plunger handle which doubles the total length of the loader prior to loading. Thus, this loader is more flimsy and may break or bend more easily than a compact loader. It also has many components and is more difficult to manufacture.

U.S. Pat. No. 1,355,684 to Northover, Oct. 12, 1920, describes a machine for stripping off rounds from stripper clips so they will be loose. It does not describe a magazine loader.

U.S. Pat. No. 2,014,177 to Herlach et al., Sep. 10, 1935, shows a box magazine and magazine loader having a lid to close on the rounds; the loader comprises many complex parts.

U.S. Pat. No. 2,403,012 to McPheters, Jul. 2, 1946, shows a large magazine loader having a lid to close on the rounds; again comprising many parts.

U.S. Pat. No. 2,462,836 to Barker et al., Mar. 1, 1949, discloses a supposedly improved stripper clip and guide having means to connect and feed round directly to a magazine on one of its sides, and means to connect to a magazine in a (specific) rifle on its opposite side. Loading is done by finger-pushing, so that the user's fingers will suffer, as discussed.

U.S. Pat. No. 2,783,570 to Kunz, Mar. 5, 1957, describes a large loader having a rim and neck holders to guide the rounds at both ends for loading loose rounds using a thruster. The thruster is separable from the loader so it can get lost.

U.S. Pat. No. 2,834,137 to Kunz, May 13, 1958, describes a loader similar to Kunz's above, but having no thruster so that loading must be done with bare fingers.

U.S. Pat. No. 2,856,720 to Kunz, Oct. 21, 1958, shows a loader basically comprising a stripper clip having an integral rounds thruster sliding inside, made for holding and loading loose rounds. This loader can only load loose rounds placed inside and cannot load rounds already on stripperclips. Its slider is separable so it can get lost, and this loader is generally flimsy.

U.S. Pat. No. 3,032,907 to Parker, May 8, 1962, describes a stripper clip composed of plastic.

U.S. Pat. Nos. 3,710,497 and 3,854,232 to Musgrave, Jan. 16, 1973 and Dec. 17, 1974 disclose a magazine loading guide for holding stripper clips and a stripper clip guide made for holding different stripper clips, respectively. These guides are not loaders.

U.S. Pat. No. 3,916,552 to Pichard et al, Nov. 4, 1975, describes a stripper clip and a machine for filling it with rounds.

U.S. Pat. No. 3,939,590 to Musgrave, Feb. 24, 1976, describes a device for emptying a magazine. This device is uncomfortable and slow to use. Further, no facilitation of loading is mentioned.

U.S. Pat. No. 4,538,371 to Howard, Sep. 3, 1985, discloses a plastic stripper clip and a magazine loader comprising neck and base holders for the rounds. Both the clip and the loader are attached to a skirt that fits on the circumference of the open side of the magazine. This loader is relatively large and flimsy and loading must be done with one's bare fingers without a plunger.

U.S. Pat. No. 4,574,511 to Csongor, Mar. 11, 1986, shows a relatively bulky loader having many parts and using an integral handle which doubles its length prior to loading.

U.S. Pat. No. 4,614,052 to Brown et al, Sep. 30, 1986, shows a firearm magazine and magazine loader having a lid to close on the rounds, comprising many parts.

U.S. Pat. No. 4,706,402 to Csongor, Nov. 17, 1987, shows a loader similar to that of Csongor's above.

U.S. Pat. No. 5,417,003 to Claveau, May 23, 1995, describes a general tool for loading and unloading magazines. This tool is uncomfortable and slow in use.

U.S. Pat. No. 5,669,171 to Sally, Sep. 23, 1997, describes a very bulky, belt-held stripper clip loader which locks on the magazine; there is no rounds plunger.

U.S. Pat. No. 6,754,987 to Cheng et al., Jun. 29, 2004, and the Beta Company of Georgia, item LCMS10, shown at http://www.betaco.com, both disclose practically the same somewhat bulky stripper clip and lose rounds loader having a very large body and a separable long plunger.

Our U.S. Pat. No. 6,810,616 Nov. 2, 2004, describes a loose rounds magazine loader and unloader. However, it is not designed to load rounds from stripper clips.

Our U.S. Pat. No. 7,059,077 Jun. 13, 2006, describes a heavy duty industrial-type 30-round magazine loader for loading loose rounds, but it is also not designed to load rounds from stripper clips.

Readily available in the private market and in the military are metal guides or adapters (US Government Stock No. 11,010,484) designed to mate a loaded stripper clip with a magazine prior to loading the magazine. Loading with open stripper clips attached to this guide is fairly difficult and cumbersome; the user always risks finger injury or pain.

In summary, bare finger loading of stripper clipped rounds or loose rounds is tedious, cumbersome, and injurious. While several loaders have been provided for facilitating this chore, most are inefficient, slow, unsafe, difficult to use, uncomfortable, large, heavy, and/or have numerous parts.

ADVANTAGES

Several advantages of one or more aspects of our creation are to provide (a) an accessory for loading both rounds bound on stripper clips and for loading loose rounds, (b) a magazine unloader, (c) a loader which is workable at high speed with minimal fatigue to a user's fingers, (d) a durable loader that is simple to operate in tough, varying, military conditions, (e) a low-cost, pocket-size, lightweight loader comprising only two parts, (f) a loader whose parts are inseparable so that either cannot be lost, and (g) a variety of such loaders that can be made to match different sizes and types of magazines, rounds, and stripper clips.

Still further advantages of various aspects will become apparent from a consideration of the drawings and ensuing description.

SUMMARY

In one aspect, an accessory and method facilitating loading rounds held on stripper clips and loading loose rounds into a firearm magazine basically comprises two parts: an elongated body adapted to fit over the rear open end of a magazine and hold a loaded stripper clip or loose rounds, and a tiltable slider adapted to slide along the body to thrust the rounds into the magazine. The slider preferably includes two spaced finger rests and a plunger in between; the slider can be tilted to the rear of the body so to allow insertion of the stripper clip or loose rounds into the body, or for storage. The loader is designed to use momentum (rather than force) with the slider to easily and very quickly strip the rounds off the stripper clip, or to thrust loose rounds, to load them into the magazine. The loader's body includes a tail protrusion used as a magazine unloader. It is currently sold under the trademark StripLULA by Maglula, Ltd. of Israel.

DRAWINGS

Figures

DRAWINGS

Reference Numerals

Figure 1A:
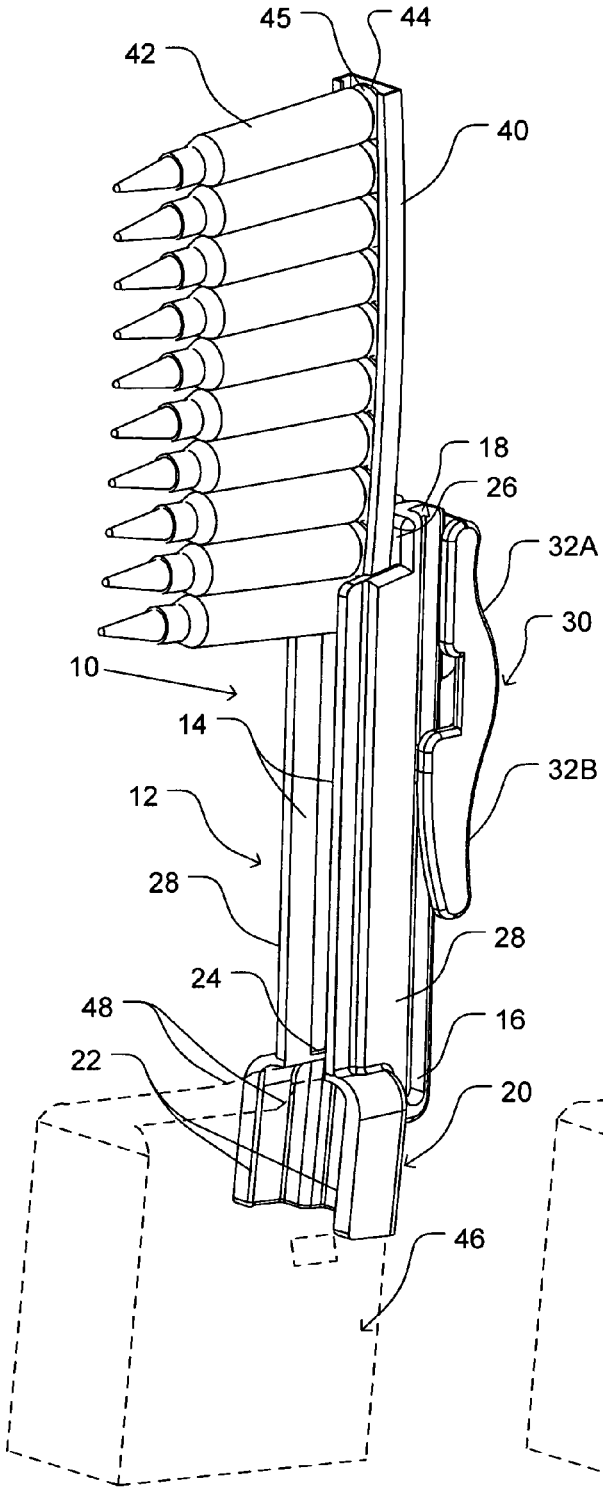
FIG. 1A is a perspective view of one aspect of a loader with a partially inserted loaded stripper clip, and a slider in a storage, non-pushable position.

10 magazine loader
10A first alternative loader
10B second alternative loader
12 upper body
12A alternative upper body
14 ribs of loader
16 slide grooves
18 stop protrusion
20 lower body
20A alternative lower body
22 lock ribs
24 ledge
26 inner back wall
28 side wall
30 slider
32A front finger rest
32B rear finger rest
34 pivot protrusion
36 plunger
38 slider void
40 stripper clip
42 round
44 rim of round
45 extractor groove
46 magazine
46A alternative magazine
48 lips of magazine
50 strip
52 shoulder
54 bracket
56 pivot pin
58 unloader protrusion

DETAILED DESCRIPTION

Preferred Embodiment—FIGS. 1A-2D and FIG. 3D

FIGS. 1A to 2D show a preferred embodiment of a magazine loader designed to fit an AR-b15 /M-16 type firearm magazine, such as the common 30-round USGI aluminum magazine, adapted for holding NATO's 5.56 mm rounds. The loader is designed for low-cost mass-production plastic injection molding where the preferred material is glass-fiber reinforced polyamide (nylon) 6 (or 6/6 or 12), which is durable and substantially resistant to gun oil and other chemicals. It can also be made of metal or a combination of plastic and metal, or made from other materials.

For other types of firearm magazines, such as the AK-47, SKS, SIG, MIA, FAL, FAMAS, Mini-14, and G36 magazines, a modified loader may be easily designed to adapt to the different dimensions of these magazines, the rounds selected, and the matching stripper clip. Nevertheless, the same basic construction and method of operation will apply.

The following description will predominantly describe a loader exampled to load rounds from a loaded stripper clip into a magazine. However, the same loader can also load loose rounds into the same magazine, and it can further unload rounds from the magazine.

FIG. 1A shows a perspective view of a loader 10 coupled to an empty firearm magazine 46, shown in broken lines, with a fully loaded 10-round stripper clip 40 being partially inserted into the loader from above. The loader and magazine are preferably held vertically upward during the loading process.

Stripper clip 40 is elongated and has a predominantly hollow rectangular 'C' or channel cross section with an elongated opening on a front side wall (looking from the left). Rounds 42 are held at their rear rim 44 ends by two opposite flanges or ribs of the stripper clip (not numbered) which extend into a portion of the rounds' extractor grooves 45. The rounds are stacked and held along the length of the clip in a straight column, as is well known in the art.

Loader 10 comprises two parts, an elongated stick-like body comprising (1) an upper body 12 integrally coupled to a skirt-like lower body 20, and (2) a slider 30 adapted to slide along upper body 12. Upper body 12 is straight or slightly curved and has a length similar to the length of the stripper clip, or shorter. Lower body 20 is adapted to fit over the open top side of the magazine along the magazine's rear side wall (the right side in FIG. 1A) on top of its lips. The upper and lower bodies of the loader preferably are integrally coupled together to provide a smooth travel path for the rounds, and may either be straight and in line with each other as shown, or the upper body may be inclined forward slightly (not shown).

Figure 2A:
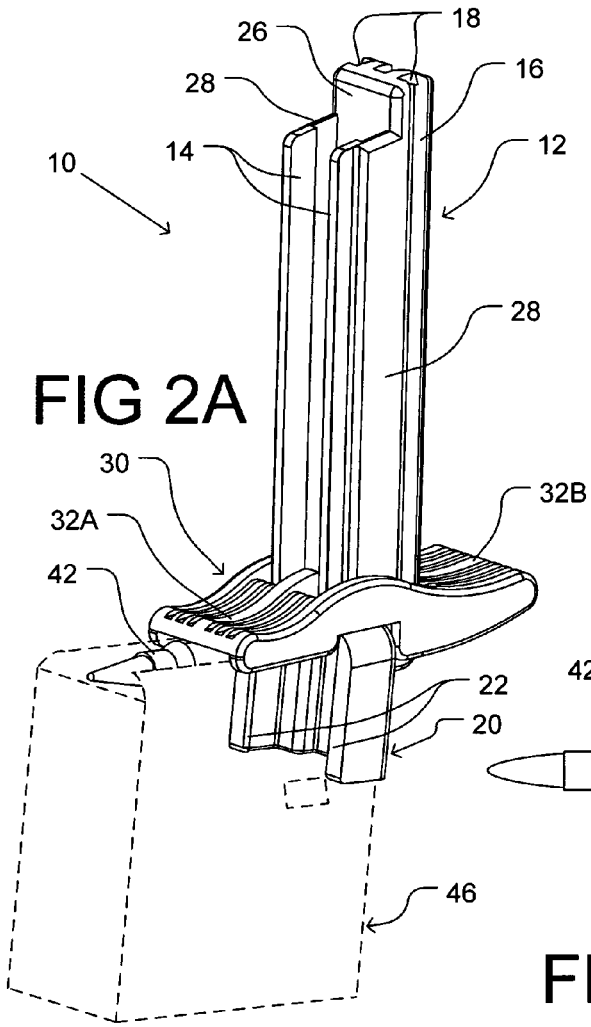
FIG. 2A is a perspective view of the loader shown with its slider pushed furthest down, without the stripper clip.

Seen from the left of FIG. 1A, the front of upper body 12 of loader 10 comprises a vertical rounds recess, opening, slot, or void (not numbered) defined by two elongated vertical, parallel, and opposing side walls 28 connected by a back wall 26 (seen best in FIG. 2A). The rounds recess is designed to receive the rear case ends of the rounds regardless of whether the rounds are loaded on a stripper clip or are loose. Each side wall 28 includes at least one vertical elongated projection, lip, or rib 14 along its inner front side protruding so as to slightly narrow the recess at or near the front. A loader for 5.56/.223 caliber AR-15/M-16 magazines will preferably have an inner distance between side walls 28 of approximately 13 mm, and an inner distance of approximately 9 mm between ribs 14, thereby defining a channel (not numbered) between back wall 26 and ribs 14 of the recess. An AR-15/M-165.56/.223 caliber stripper clip has a width of approximately 12.5 mm, and when inserted from above into the channel behind ribs 14, it cannot drop or exit forward beyond ribs 14, and can only enter or exit the loader from its top. Apart from limiting the forward movement of the stripper clip when in the loader, ribs 14 also limit the sideways movement of the rounds to keep them in a straight column. Ribs 14 are preferably spaced to slightly grip or clutch the case of loose rounds when in the rounds recess so that the rounds will not drop or move forward from the loader and be in a straight column. Thus, as stated, the loader can load both loose rounds and rounds from stripper clips.

Figure 1B:
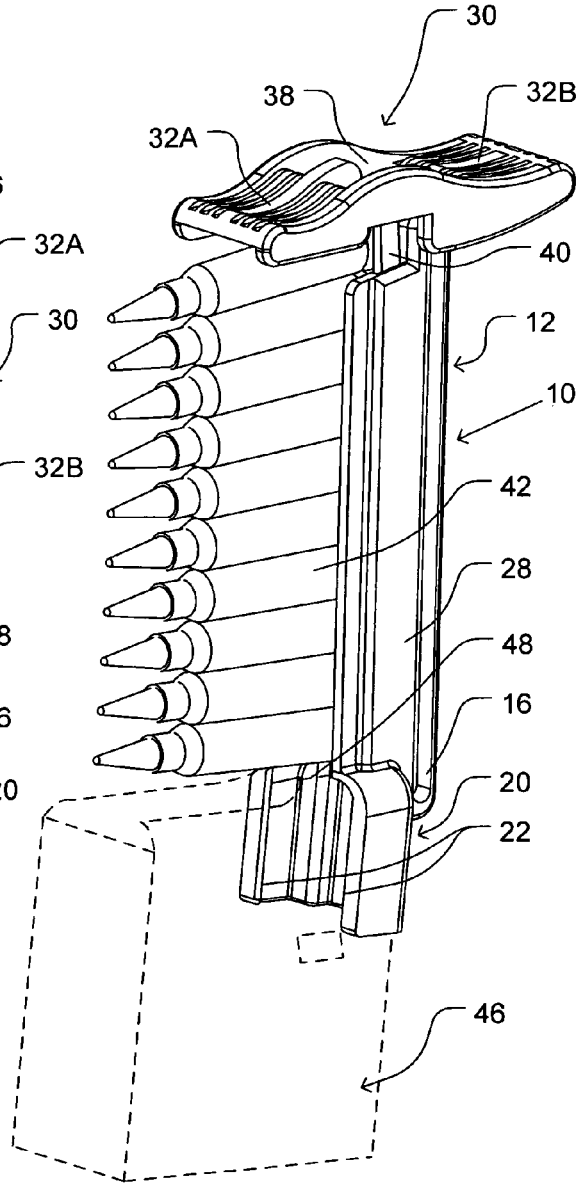
FIG. 1B is the loader of FIG. 1A with the loaded stripper clip completely inserted and the slider in a pushable top position.

The rounds recess further includes two opposing inwardly-facing ledges 24 at its bottom (only one is shown in FIG. 1A) designed to engage and stop further downward movement of stripper clip 40. These ledges block the lower end of the stripper clip from exiting upper body 12 and entering the magazine; thus they will hold the bottom round just above the lips of the magazine 48 prior to loading, as shown in FIG. 1B.

FIG. 1A also shows an elongated vertical slide groove 16 along the length of upper body 12. A parallel and mirror groove exists at the opposite side of the upper body. Grooves 16 are approximately 3.5 mm deep and terminate on their distal ends by a bottom stop (not numbered), and an upper stop protrusion 18 located in each groove. Protrusions 18 slope outwardly from the groove towards its bottom, forming a stop ledge at its bottom.

Seen from the left of FIG. 1A, lower body 20 comprises a substantially hollow skirt-like member defined by two side walls, a rear wall connecting the two side walls, and a substantially open front. It further includes an open bottom, and a substantially open top (all not numbered). These provide a magazine recess, compartment, opening, or void adapted to be mounted on a rear portion of the magazine's open top side or end. Lower body 20 is designed so that when it is fitted or coupled to or over the magazine, it positions upper body 12 over the magazine such that the rounds traveling down from it will enter sequentially and be centered between lips 48 of the magazine where the rear closed ends of the rounds will lie adjacent the inside rear wall of the magazine (not numbered).

Lower body 20 includes a securing mechanism for securing the loader to the magazine. In the case of a loader for AR-15/M-16 magazines, lower body 20 has two 'male' parallel, vertical, and mirrored lock ribs 22 near its front face projecting inside (also shown in FIG. 2B). These lock ribs are adapted to slide from above and fit with some pressure inside two matching 'female' grooves or recesses (not numbered) in respective side walls of the magazine. These magazine grooves are made by AR-15/M-16 magazine manufacturers especially for receiving and aligning the readily-available metal stripper clip guides (mentioned above). Lower body 20 virtually replicates this metal guide so as to mate securely and correctly with the magazine.

Slider 30 of the loader is shown positioned along and parallel the rear wall of upper body 12 in a non-pushable position. The slider preferably includes a mechanism (not shown) for locking it on the body in this position for storage. Slider 30 is substantially rectangular and has a top side, shown best in FIG. 1B, and a bottom side or surface, with a front finger rest or press 32A and a rear finger rest or press 32B on its top side. It has two inwardly-facing, mirror-image, cylindrical pivot protrusions 34 at its side walls, shown in FIG. 2D, which are adapted to fit inside and slide along slide grooves 16 of the upper body. Pivot protrusions 34 also allow the slider to pivot from the position of FIG. 1A, where it is parallel to and on the rear side of upper body 12, to the position of FIG. 1B where it is substantially perpendicular and on top of the upper body. Once assembled on the upper body, the slider can slide only between the two distal stop protrusions of slide groove 16, i.e., between the bottom stop and upper stop 18. When it is moved to meet protrusion 18 it can be rotated to the position of FIG. 1B, but it cannot be extracted from these grooves.

FIG. 1B shows the loader coupled to the empty magazine with the loaded stripper clip fully inserted in the loader. The rounds extend out the front wall of the loader between ribs 14. The clip and rounds can be inserted with ease into the loader from the position shown in FIG. 1A to that of FIG. 1B with little friction from ribs 14. Slider 30 is shown raised above the rounds and positioned in a pushable position for loading or forcing the rounds into the magazine. The slider has a substantially rectangular opening or void 38 (FIGS. 1B and 2D) approximately at its center and includes pivots 34 (FIG. 2D). Slider void 38 is dimensioned to receive upper body 12 inside, and slide along it without substantial friction. As stated, when slider 30 is moved to the top of upper body 12 (FIG. 1B) it can be turned to the position shown, and there it is supported by the top-most round in the loader. The lower round in the loader is shown next to the open top side of the magazine, centered between lips 48.

Loose rounds may be placed in the rounds recess of upper body 12 by sequentially inserting them from the top, one by one, with the back or rim end of the cases adjacent inner back wall 26 of the upper body.

FIG. 2A shows the loader coupled to the magazine after slider 30 has been forced or pushed down to load the rounds into the magazine. The slider is fully down and the stripper clip has been removed from the loader. Magazine 46 is loaded, with only the top-most round visible; the rest of the rounds are not visible but are inside the magazine.

Figure 2B:
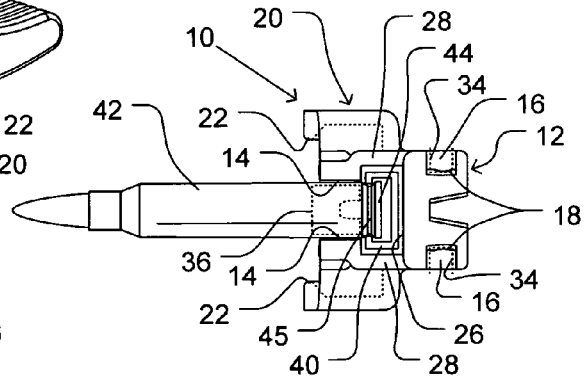
FIG. 2B is a top view of the body of the loader with a stripper clip holding a round.
Figure 2D:
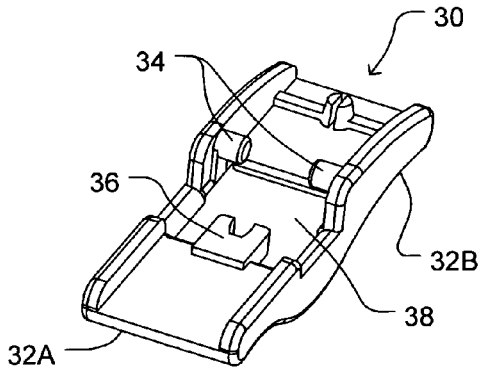
FIG. 2D is a perspective bottom view of the slider.

FIG. 2B shows a top view of the loader without the slider and magazine with a stripper clip 40 shown fully contained inside the rounds recess to the right of ribs 14 and to the left of inner back wall 26. The stripper clip holds a round 42 at its extractor groove 45. Ribs 14 of the loader secure or hold both sides of the rounds with slight pressure so as to prevent the rounds from deflecting sideways while under loading pressure from the slider above and for keeping the lowest round from hitting a lip of the magazine. The slider has a plunger or thruster 36, shown in broken lines, at its bottom surface which engages the rear of the case of the top-most round in the loader. Also shown from the top are two lock ribs 22 of lower body 20, and the two pivot protrusions 34 of the slider, shown in dotted lines, inside slide grooves 16 of upper body 12, below stop protrusions 18.

Figure 2C:
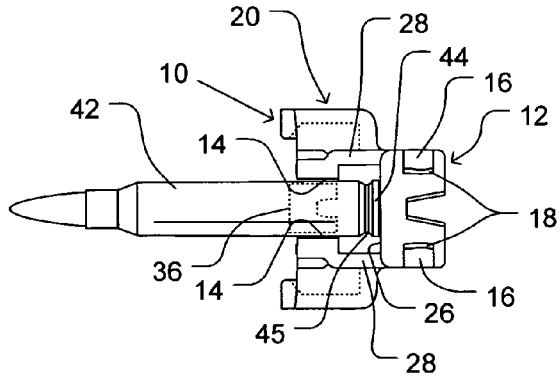
FIG. 2C is a top view of the body of the loader holding a loose round.

FIG. 2C shows a top view of the loader without the slider and magazine and with a loose round 42 held between ribs 14. The rear, rim, surface of the rounds parallel and preferably touching inner back wall 26 when the rounds are stacked in the rounds recess. Plunger or thruster 36 of the slider is shown in broken lines engaging the top-most round in the loader.

FIG. 2D shows the bottom surface and void 38 of slider 30, the two pivots 34 inside the void, and plunger 36. Plunger 36, which may have many variations, projects into opening 38 and from the bottom surface of the slider such that when the slider is fully down, shown in FIG. 2A, the plunger preferably will be between and slightly below the lips of the magazine so as to allow the top-most round in the magazine to be slightly below the lips. The plunger is designed to extend between ribs 14 of the upper body, FIG. 2B, to be close to the stripper clip so that it will engage and force the top-most round down close to its rim so not to produce a downward bending torque on the rounds. A torque on the rounds in any direction will increase friction between the extractor groove of the rounds and the flanges of the stripper clip holding it which will require higher thrusting force from the user, and may even halt loading.

When loading loose rounds, the current position of the plunger remains, and is adequate.

Figure 3A:
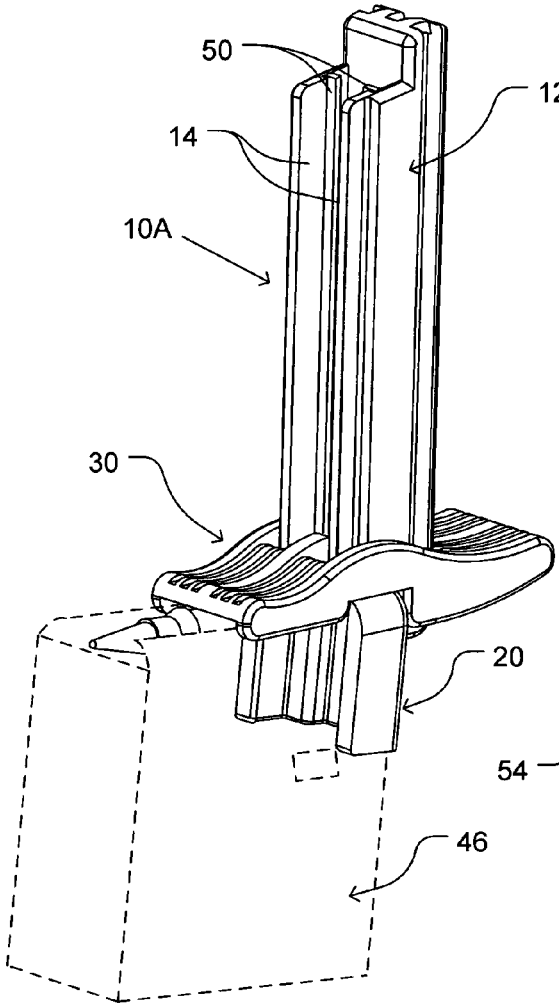
FIG. 3A is a perspective view of a first alternative loader having internal flanges, shown with its slider down.
Figure 3C:
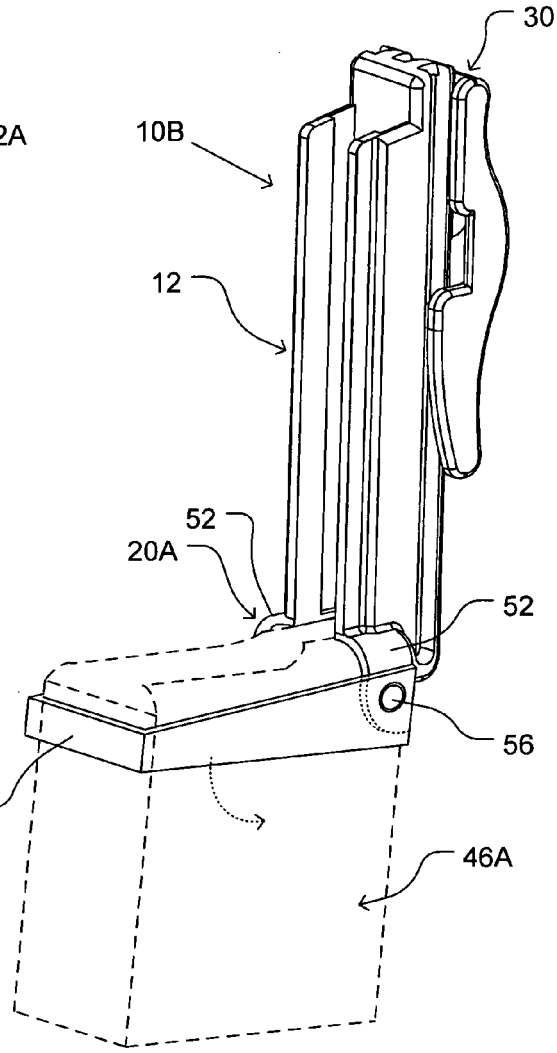
FIG. 3C is a perspective view of a second alternative loader having alternative lower body.
Figure 3B:
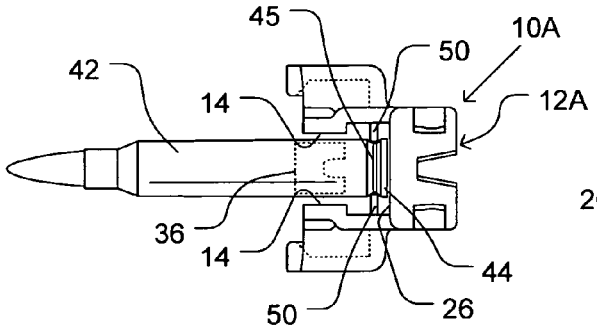
FIG. 3B is a top view of the body of the first alternative loader.
Figure 3D:
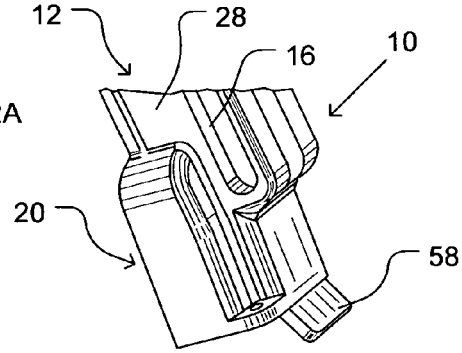
FIG. 3D is a portion of a perspective rear view of the loader with an unloader protrusion.

FIG. 3D is a perspective rear view of loader 10 showing an unloader protrusion or flange 58 extending out from preferably the bottom and center of lower body 20. The flange preferably has a rectangular cross section approximately 4 mm by 12 mm with at least a 5 mm length.

OPERATION

Preferred Embodiment—FIGS. 1A-2D and FIG. 3D

The loader provides substantial assistance to firearm users by enabling them to safely and very rapidly load rounds from a stripper clip or load loose rounds into a magazine. It may also unload rounds from the magazine. The loader may be adapted to load any type of firearm magazine designed to hold double-stacked rounds reaching its open top with any matching rounds and stripper clips.

The following description of operation will predominantly describe a loader exampled to load rounds from a loaded stripper clip into a magazine. Loading of loose rounds and unloading will also be described.

In practice, the user first fits lower body 20 of loader 10 onto the rear open top of a matching magazine, as shown in FIG. 1A, where lock ribs 22 enter the female recesses of the magazine as previously explained. The user then slides or drops a loaded stripper clip inside the top rounds opening or recess of the loader's upper body, as also shown in FIG. 1A. The stripper clip is stopped by two ledges 24 from entering the magazine. The slider is then unlocked or moved from the rear of the upper body along slide grooves 16 until its pivots 34 engage stop protrusions 18 to be turned there on its pivots (here counterclockwise) to the top pushable position shown in FIG. 1B.

The user then places the bottom of the magazine on a support, such as a table or knee, or holds the magazine by hand, and rests two adjacent fingers on finger rests 32A and 32B of the slider. The user can then force the slider toward the magazine to force or strip the rounds out of the stripper clip and load them in succession into the magazine. This takes but an instant. Plunger 36 engages and forces the top-most round down, which in turn pushes the round below down and so forth down. The rounds enter the magazine in succession, centered between its lips 48. Ledges 24 hold the stripper clip on both its lower sides and act against the slider, as a contra-force, so as to allow the rounds to be stripped off the stripper clip.

Providing sufficient vacant space is available in the magazine, the user can repeat the loading operation to load one or more additional stripper clips by first turning the magazine and loader upside down to allow the stripper clip to slide and free fall out of the loader and for the slider to slide down along the body to engage stop protrusions 18. The user then turns the loader and magazine back up and rotates the slider back to a non-pushable position parallel the upper body. A new loaded stripper clip may now be placed in the loader. The user repeats the above actions until the magazine is full.

Loose rounds may be placed in the loader by first preferably holding the magazine and loader substantially horizontal with the slider at the rear in the non-pushable position. The rounds are then sequentially inserted from the top, one by one, into the rounds recess with the rim end of the cases all the way back contacting inner back wall 26 of the upper body, as shown in FIG. 2C. The rounds may be stacked in the loader until the rounds recess is completely full; ten rounds in the loader designed; although fewer rounds may be stacked and loaded into the magazine. The pressure of ribs 14 on the rounds is preferably designed to keep the rounds from falling out of the loader even if the loader is turned so the rounds point to ground.

To load the rounds into the magazine, the user repeats the operation with the slider as explained above with respect to loading rounds from a stripper clip.

Once the magazine is full, the loader is pulled away from the magazine and the slider is rotated back to be locked for storage on the rear of the upper body (FIG. 1A).

To unload rounds from the magazine, the user holds the upper body of the loader in one hand and the filled magazine with the other hand pointing the rounds substantially down to the ground. Next the user presses the second round in the magazine with unloader flange 58 paralleling the round with enough force to release the spring pressure from the top-most round. The top-most rounds then free falls to ground. This operation is repeated continuously, as is well known in the art, until all the rounds are expelled from the magazine.

For its size, this loader allows very quick and comfortable magazine loading from both stripper clips and loose rounds. Ribs 14 of the upper body and plunger 36 of the slider contribute to the loading speed and ease by limiting sideways deflection of the rounds under loading, and by pressing the top-most round near its rim, respectively, thus reducing friction and torque between the rounds and the stripper clip. The momentum created when the user quickly forces down the slider renders loading virtually effortless.

Insofar as we are aware, no other prior-art loader has only two parts which are inseparable (against loss of one part), can load loose and bound rounds, has small size and volume, is comfortable to carry and use, is lightweight, has an integral comfortable finger rests for avoiding direct finger pressure on the rounds and the pain associated with such pressure, is durable in construction, and has an unloader feature.

DETAILED DESCRIPTION

First Alternative Embodiment—For Loose Rounds—FIGS. 3A-3B

In a slightly modified embodiment, loader 10 may be adapted to load loose rounds in a different way using alternative loader 10A of FIGS. 3A and 3B. Loader 10A virtually has the same slider, lower body, and upper body construction as loader 10 previously described, but with an addition of a pair of thin, vertically standing, elongated, preferably metal, strips 50 positioned to the rear and along each rib 14 of a modified upper body 12A, left of inner back wall 26. Strips 50 have a distance between them sized and positioned to grasp or hold extractor grooves 45 of the cases of the rounds, similar to the way the two flanges or ribs of the stripper clip hold the rounds, thus mimicking the stripper clip. This is shown in FIG. 3B where strips 50 hold round 42 at or in its extractor groove. Metal strips are preferably incorporated into the upper body during the plastic injection of the loader's body. In a less-preferred option, these strips can be made of plastic as part of the upper body. Each strip or rib is approximately 0.5 mm thick and protrudes approximately 0.5 mm into the extractor groove on each side.

This loader can be used to load also rounds from stripper clips (not shown) if enough space is made for the stripper clip to be contained between and along strips 50 and ribs 14; ribs 14 may then be made more distant thereby reducing clutching pressure or friction with the rounds.

OPERATION

First Alternative Embodiment—FIGS. 3A-3B

With loader 10A, a user can load loose rounds, one-by-one, into the upper body from above by positioning the extractor groove of each round between strips 50 and forcing the top round down, and all the rounds below it, further into the upper body. This operation is similar to loading an empty stripper clip with rounds. Once the loader is full of rounds, they can be loaded quickly by using the slider to force the rounds into the magazine as described previously.

Alternatively, a user may simply keep an empty stripper clip 40 in loader 10 and may load loose rounds into the clip from above, one-by-one, without taking it off the loader (FIG. 1B), and then load the magazine as previously described.

DETAILED DESCRIPTION

Second Alternative Embodiment—Extended Lower Body—FIG. 3C

In another slightly modified embodiment, FIG. 3C shows a loader 10B comprising the same upper body 12 (or 12A of FIGS. 3A and 3B) with an extended skirted lower body 20A that encompass the top open side of some firearm magazine 46A. Lower body 20A includes two skirted side walls or shoulders 52 extending down from the upper body over the sides of the magazine. Near the bottom of each shoulder a cylindrical pivot pin 56 projects sideways and outward. A bracket or brace 54 is pivoted on pins 56. When loader 10B is removed from the magazine, bracket 54 can be pivoted counterclockwise (as shown by the dotted arrow) to fold (not shown) adjacent the rear of the upper body, to save space during storage and transport. Bracket 54 holds the top open side of the magazine tightly to secure the upper body to the magazine in deployed position of FIG. 3C. Bracket 54 has limit or stops (not shown) to position the upper body at substantially right angle to the open top of the magazine.

Further, loader 10B may be manufactured comprising upper body 12 with several replaceable brackets 54, each sized and adapted to a different magazine type (such as the SIG, G36, FAMAS, etc.). Thus, the manufacturer or user will be able to easily couple a bracket 54 for a specific magazine onto shoulders 52 by snapping it onto pin 56 prior to sale or use.

Still further, in a simplified loader, lower body 20A may comprise shoulders 52 and bracket 54 combined as a single part which is not foldable or replaceable coupled to the upper body.

Thus, we have shown just one example of a lower body which is foldable and/or replaceable and which couples to the perimeter of the magazine.

OPERATION

Second Alternative Embodiment—FIG. 3C

With loader 10B as described above, a user first unfolds bracket 54 from a storage position and then attaches it onto the magazine as shown, positioning the upper body above the magazine ready for loading. Loading of the magazine with rounds is as described above for the preferable embodiment.

CONCLUSION, RAMIFICATIONS, AND SCOPE

The reader will see that we have provided several variations of an efficient, pocket-size accessory and method for loading rounds both from stripper clips and loose rounds into a magazine, and which includes an unloader feature. It provides more comfort and safety for the user by eliminating use of improvised field tools or improvised loading methods. It eliminates the use of bare fingers to load and unload rounds so as to prevent pain and injury. The loader described is also more durable in construction and smaller than other loaders we are aware of, and functions better.

While the above description contains many specificities, these should not be construed as limitations, but rather as an exemplification of several preferred embodiments. The following are examples of some possible variations and ramifications:

All numerical values provided are approximate and can be varied to conform with other magazines, round types and/or sizes, matching stripper clips, or to operate better.

The construction of the slider may by varied and/or be constructed elsewhere in the loader, e.g. by positioning it at 90 degrees (sideways) and not front-to-back as shown here.

The lower body can be more elongated (extended down) to encompass a larger part of the magazine for reducing jiggling on the magazine in case some magazines' outer dimensions vary. Alternatively, one or more downward fixed or slidable extensions from the lower body can be added for the same purpose.

Other magazine securing or locking mechanisms may be substituted for lower body 20. For example, when designing a loader for mini-14, G36, or SKS magazines, the lower body must be modified to fit such magazines which have an upper part different from an AR-15/M16 magazine.

The upper and/or lower body part may be made to fold, collapse, or be taken apart such that they may be more compactly packed for storage and carrying. They can then be fixed, assembled or extracted prior to use.

The lower body can be made without lock ribs 22 and still the loader will be operative. It may further have adjusting means, inserts, or a locking mechanism. It may be sized or skirted to encompass the entire upper open top of a magazine if there are no holding or securing means incorporated in the magazine.

The lower body of the loader may include an internal or external spring member positioned to help secure the loader better on magazines of different widths or to assist the plastic material, if any, of the lower body to come back to dimension after it has been widened due to fit on a wide magazine. The spring member may be a spring wire or a flat spring positioned such to constantly force the opposing side walls 28 inwards towards each other.

The upper body of the loader may have adjusting means, inserts, or be sized differently for receiving different stripper clips and loose rounds inside.

The upper body may be made longer or shorter to include more or less rounds, respectively. For example it can be made longer to load fifteen rounds at a time or shorter to load only five rounds.

The upper body may further be made to load only loose rounds if the rounds recess is dimensioned smaller so not to accept a stripper clip inside, but only loose rounds. On the other hand, if the distance between ribs 14 is increased beyond the diameter of the case of the rounds, it would be uncomfortable to load loose rounds as they will not be held in place in the rounds recess prior to loading, as they may fall out. Thus, the loader will load only rounds from stripper clips.

Ribs 14 of the loader may include adjustment ribs along a portion of their length such to increase the holding pressure on the rounds placed in the rounds recess—especially required for loading loose rounds.

A different unloader protrusion or section may be included, having different dimensions or different geometry, or may be placed elsewhere on the loader. An added unloading mechanism may also be incorporated with the loader.

The upper body may be made extendable, collapsible, hinged, and/or have several mating sections assembled prior to use so to enable the loader to receive more rounds, or to compact better.

An industrial machine using the ideas, methods, and basic construction described here may be designed for mass loading rounds into magazines. This machine may be used in military armories, shooting ranges, and in production plants.

An electromechanical device, such as an electric motor or solenoid, or an air cylinder or piston, and a power source (batteries, AC line, or air pressure), and a controller or switch, may be included in a modified loader, or with the above described machine. This may electromechanically or pneumatically tilt, slide, and thrust the slider previously described, or similar, for volume loading operation.

Accordingly, the scope of the creations describes should be determined, not by the embodiments illustrated, but by the appended claims and their legal equivalents.

The invention claimed is:

1. A loading device for loading both a plurality of loose ammunition rounds or cartridges and for loading a plurality of rounds held by a stripper clip into a firearm magazine, said magazine comprising a substantially hollow body having a predetermined shape and size and an open top end, said ammunition rounds each having a predetermined size and shape with a case end having a rim or flange, and an opposite bullet or crimped end, said stripper clip holding said rounds in a single column, said loading device comprising:

(a) an elongated upper body having two opposing elongated side walls and an elongated back wall, said back wall connecting said two opposing side walls so as to define an elongated rounds recess or void between said elongated side walls, each of said side walls having an elongated lip or rib at its inner front distal from said back wall along the length of each side wall, said rounds recess having a predetermined shape and size for receiving said stripper clip holding said rounds and for receiving said loose rounds, said upper body further having two opposite and parallel elongated slide grooves along its respective sides on the outsides of said side walls, (b) a lower body being connected to said elongated upper body and comprising a pair of side walls and a rear wall connecting said side walls to define a magazine recess or compartment having a skirted shape, said lower body being sized and shaped to fit over a rear end of said open top of said magazine, (c) said elongated rounds recess communicating with said magazine recess so to allow passage of said rounds from said upper body to said lower body, (d) a slider or pusher having top and bottom surfaces with a finger press area on said top surface and a plunger on said bottom surface, said slider including a void between said top and bottom surfaces with two inwardly facing pivots adjacent said slider void, each of said pivots being shaped and sized to fit and slide in and along said slide grooves of said upper body, said pivots of said slider being attached to and inseparable from said two opposite and parallel elongated slide grooves along the outsides of said side walls of said upper body, whereby when said magazine is placed in said magazine recess, a user can load it with said ammunition rounds quickly, easily, and safely by inserting either said stripper clip holding said rounds into said rounds recess or by inserting said loose rounds into said rounds recess and pushing said slider toward said magazine to force said rounds sequentially into said magazine, and said loading device has two parts, is comfortable to use, light in weight, and durable.

2. The loading device of claim 1 wherein said slider has a generally rectangular shape with solid portions that each have a generally rectangular shape on opposite sides of said slider void, said void having a generally rectangular shape.

3. The loading device of claim 2 wherein said plunger comprises a projection extending into said slider void from one of said solid portions.

4. The loading device of claim 1 wherein each of said slide grooves include an upper and a lower stop for limiting the travel of said slider along said slide grooves.

5. The loading device of claim 1 wherein said slider is tiltable about said upper body between a non-pushable or storage position and a pushable or operative position.

6. The loading device of claim 5 wherein said plunger is arranged to engage a top-most round in said rounds recess and will be positioned between said elongated lips or ribs of said side walls of said upper body when said slider is in said pushable or operative position.

7. The loading device of claim 1 wherein said lower body further includes mounting means pivotably connected to said side walls of said lower body, said mounting means being pivotable to a storage position adjacent said upper body to effect a compact arrangement and an operative position generally perpendicular to said upper body where it can be attached to said magazine and hold said upper body to said magazine.

8. The loading device of claim 1, further including an unloader flange projecting from said lower body sized and adapted to assist unloading of said rounds out from a loaded said magazine.

9. A method of loading a plurality of ammunition rounds or cartridges into a firearm magazine, said magazine comprising a substantially hollow body having a predetermined shape and size and an open top end, said ammunition rounds each having a predetermined size and shape with a case end having a rim or flange, and an opposite bullet or crimped end, comprising:

(a) providing a loading device that can be attached to said magazine and slidably receive in a rounds recess thereof the case ends of a plurality of said rounds such that said rounds are positioned to be pushed into said magazine, said loading device including a coupled slider or pusher that is inseparable from said loading device and that can be (1) positioned in a non-pushable position in which said slider is still coupled to said loading device but which allows said rounds to be inserted into and held by said rounds recess, and (2) moved to a pushable position where it can be pushed to force said rounds into said magazine, (b) positioning said slider in said non-pushable position and inserting said rounds into said rounds recess, (c) moving said slider to said pushable position and pushing said slider to force said rounds into said magazine, whereby a user can load said magazine with said plurality ammunition rounds whether said rounds are initially loose or held by a stripper clip quickly, easily, and safely, and said loading device has two parts, is comfortable to use, is light in weight, and is durable.

10. The method of claim 9 wherein said loading device comprises an elongated channel with a pair of slots on opposite sides thereof and said coupled slider comprises a pair of projecting pivots that are engaged in said respective slots.

11. The method of claim 9 wherein said slider includes a plunger, said plunger being arranged so that, when said slider is in a pushable position, said plunger engages a top-most round in said rounds recess of said loading device.

12. The method of claim 9, further including providing an unloader flange projecting from said loading device sized and adapted to assist unloading of said rounds out from a loaded said magazine.

13. A loading device for loading a plurality of ammunition rounds or cartridges held by a stripper clip into a firearm magazine, said magazine comprising a substantially hollow body having a predetermined shape and size and an open top end, said ammunition rounds each having a predetermined size and shape with a case end having a rim or flange, and an opposite bullet or crimped end, said loading device comprising:

(a) an elongated upper body having an elongated rounds recess or void, said rounds recess having a predetermined shape and size for receiving said stripper clip holding said plurality of ammunition rounds or cartridges, (b) a lower body being connected to said elongated upper body and having a magazine recess or compartment sized and shaped to fit over said open top of said magazine, (c) said elongated rounds recess communicating with said magazine recess so to allow passage of said rounds from said upper body to said lower body, and (d) a slider or pusher that is inseparable from said loading device and is coupled to and slideable along said upper body from (1) a non-pushable or storage position in which said slider is still coupled to said loading device but which allows said stripper clip to be inserted into and held by said loading device, and (2) a pushable or operative position where said slider can be pushed to force said rounds from said stripper clip into said magazine, whereby when said magazine is placed in said magazine recess, a user can load it with said ammunition rounds quickly, easily, and safely by inserting said rounds held by said stripper clip into said rounds recess and moving said slider from said non-pushable or storage position to said pushable or operative position and toward said magazine to force said rounds sequentially into said magazine, and said loading device has two parts, is comfortable to use, is light in weight, and is durable.

14. The loading device of claim 13 wherein said slider includes pivot means for pivoting said slider about said upper body between said non-pushable or storage position and said a pushable or operative position.

15. The loading device of claim 14 wherein said pivot means comprises two inwardly facing cylindrical protrusions and said upper body has a pair of slide grooves, said cylindrical protrusions being sized and shaped to fit inside and slide along said slide grooves.

16. The loading device of claim 14 wherein said slider includes a plunger, said plunger is arranged to engage the rear of a top-most round in said loading device when said slider is in said pushable position.

17. The method of claim 9 wherein said loading device comprises an elongated channel with a pair of slots on opposite sides thereof and said coupled slider comprises a pair of projecting pivots that are engaged in said respective slots.

18. The loading device of claim 13 wherein said rounds recess of said elongated upper body is also shaped and sized for receiving a plurality of loose or individual ammunition rounds or cartridges.

19. The loading device of claim 18 wherein said rounds recess hold said loose ammunition rounds by their case end.

20. The loading device of claim 13, further including an unloader flange projecting from said loading device, said flange being sized and adapted to assist unloading of said rounds from a loaded magazine.

* * * * *